US010906694B2

(12) United States Patent
Sugar et al.

(10) Patent No.: US 10,906,694 B2
(45) Date of Patent: Feb. 2, 2021

(54) COLLAPSIBLE CRATE

(71) Applicant: Pilkington Group Limited, Lathom (GB)

(72) Inventors: Justin Sugar, Grove City, OH (US); Robert Langham, Beavercreek, OH (US)

(73) Assignee: Pilkington Group Limited, Lathom (GB)

( * ) Notice: Subject to any disclaimer, the term of this patent is extended or adjusted under 35 U.S.C. 154(b) by 121 days.

(21) Appl. No.: 16/140,855

(22) Filed: Sep. 25, 2018

(65) Prior Publication Data

US 2019/0092518 A1 Mar. 28, 2019

Related U.S. Application Data

(60) Provisional application No. 62/563,679, filed on Sep. 27, 2017.

(51) Int. Cl.
*B65D 6/26* (2006.01)
*B65D 21/08* (2006.01)
(Continued)

(52) U.S. Cl.
CPC ..... *B65D 9/24* (2013.01); *B65D 9/06* (2013.01); *B65D 9/12* (2013.01); *B65D 19/16* (2013.01);
(Continued)

(58) Field of Classification Search
CPC ..... B65D 9/24; B65D 9/12; B65D 21/086; B65D 19/16; B65D 9/06; B65D 2519/00164; B65D 2519/00572; B65D 2519/00323; B65D 2519/00069; B65D 2519/00661; B65D 2519/00034; B65D 2519/00099; B65D 2519/00094;
(Continued)

(56) References Cited

U.S. PATENT DOCUMENTS 1,587,711 A * 6/1926 Flagstad ..... B65D 9/12 217/56
1,987,727 A * 1/1935 Wolfenden ..... B65D 9/12 217/43 R
(Continued)

FOREIGN PATENT DOCUMENTS

DE 4218346 A1 12/1993
EP 0071467 A2 2/1983
(Continued)

*Primary Examiner* — Kareen K Thomas
(74) *Attorney, Agent, or Firm* — Marshall & Melhorn, LLC

(57) ABSTRACT

A collapsible crate and a method for synchronizing a method of assembling a collapsible crate are provided. The collapsible crate comprising a base, a first panel, a second panel, and a band style fastener. The first panel and the second panel are at least partially disposed within gaps between stringers of the base. The band style fastener is disposed about a portion of the base and a portion of one of the first panel and the second panel. The band style fastener secures the one of the first panel and the second panel to the base. The first panel and the second panel at least partially disposed in the base facilitates a transition fit therebetween. The collapsible crate is compact when the crate is collapsed and decreases a cost of the crate.

21 Claims, 5 Drawing Sheets

(51) Int. Cl.
*B65D 19/16* (2006.01)
*B65D 6/02* (2006.01)
*B65D 6/16* (2006.01)

(52) U.S. Cl.
CPC .. *B65D 21/086* (2013.01); *B65D 2519/00024* (2013.01); *B65D 2519/00029* (2013.01); *B65D 2519/00034* (2013.01); *B65D 2519/00059* (2013.01); *B65D 2519/00064* (2013.01); *B65D 2519/00069* (2013.01); *B65D 2519/00094* (2013.01); *B65D 2519/00099* (2013.01); *B65D 2519/00104* (2013.01); *B65D 2519/00164* (2013.01); *B65D 2519/00169* (2013.01); *B65D 2519/00174* (2013.01); *B65D 2519/00199* (2013.01); *B65D 2519/00203* (2013.01); *B65D 2519/00208* (2013.01); *B65D 2519/00273* (2013.01); *B65D 2519/00293* (2013.01); *B65D 2519/00323* (2013.01); *B65D 2519/00333* (2013.01); *B65D 2519/00502* (2013.01); *B65D 2519/00572* (2013.01); *B65D 2519/00611* (2013.01); *B65D 2519/00661* (2013.01); *B65D 2519/00711* (2013.01); *B65D 2519/00875* (2013.01)

(58) Field of Classification Search
CPC ..... B65D 2519/00024; B65D 2519/00174; B65D 2519/00199; B65D 2519/00208; B65D 2519/00104; B65D 2519/00711; B65D 2519/00059; B65D 2519/00611; B65D 2519/00029; B65D 2519/00064; B65D 2519/00875; B65D 2519/00203; B65D 2519/00273; B65D 2519/00293; B65D 2519/00333; B65D 2519/00502; B65D 2519/00169
USPC ..... 217/5, 6, 36, 40, 42, 43 R; 220/4.28, 220/4.03, 4.33, 4.08, 4.09, 6, 7
See application file for complete search history.

(56) References Cited

U.S. PATENT DOCUMENTS

| | | | | | |
|---|---|---|---|---|---|
| 2,686,646 | A * | 8/1954 | McMillan | B65D 19/16 | 108/55.1 |
| 2,783,911 | A * | 3/1957 | Bussing | B65D 19/10 | 220/7 |
| 3,613,931 | A * | 10/1971 | Schifferle | B65D 9/12 | 217/12 R |
| 4,165,806 | A * | 8/1979 | Cayton | B65D 19/38 | 108/53.1 |
| 4,339,047 | A * | 7/1982 | Johansson | B65D 19/12 | 206/509 |
| 5,109,986 | A * | 5/1992 | Pruitt, Jr. | B65D 19/16 | 206/600 |
| 6,098,803 | A | 8/2000 | Tanaka et al. | | |
| 6,170,688 | B1 * | 1/2001 | Olden | B65D 9/14 | 217/45 |
| 2001/0045409 | A1 * | 11/2001 | Kinnear | B65D 9/34 | 217/45 |
| 2007/0102314 | A1 * | 5/2007 | Dedmon | B65D 77/061 | 206/386 |
| 2007/0194019 | A1 * | 8/2007 | Seagle | B65D 19/18 | 220/4.08 |
| 2008/0277392 | A1 * | 11/2008 | Sorensen | B65D 19/12 | 220/1.5 |
| 2011/0155726 | A1 | 6/2011 | Hall et al. | | |
| 2014/0209600 | A1 * | 7/2014 | Schloesser | B65D 11/1873 | 220/4.33 |
| 2016/0039602 | A1 * | 2/2016 | Pawluk | B65D 88/522 | 414/800 |
| 2017/0021999 | A1 * | 1/2017 | Pawluk | B65D 90/0033 | |
| 2017/0349324 | A1 * | 12/2017 | Golanowski | B65D 11/1833 | |

FOREIGN PATENT DOCUMENTS

| | | | |
|---|---|---|---|
| FR | 2082383 | A5 | 12/1971 |
| WO | 0017068 | A1 | 3/2000 |
| WO | 2011148189 | A1 | 12/2011 |

* cited by examiner

COLLAPSIBLE CRATE

CLAIM OF PRIORITY

The present application claims priority to and incorporates by reference U.S. Provisional Application No. 62/563,679 filed Sep. 27, 2017, entitled "COLLAPSIBLE CRATE."

BACKGROUND OF THE INVENTION

Collapsible crate designs to date have been needlessly complex. Typically, existing designs have relied on interlocking fits between parts to secure the crate components to one another. Such designs require additional and complex movements of the panels to assemble such collapsible crates. In one design, wall panels of the crate feature a "foot" or a protruding portion that interlocks with another section of the crate, requiring the panel to be moved in two individual directions as the panel is inserted into the base. Insertion of another section of the crate then locks the wall panel into place. In another design, wall panels of the crate feature notches that interlock with an adjoining section of the crate. The notched panel must be initially inserted obliquely into the base of the crate, then tilted into a secured position where the notch interlocks with the adjoining section. Such designs needlessly limit and complicate assembly options for users of the crates, while also requiring custom features to be incorporated into the wall panels (such as feet or notches) that increase a manufacturing cost of the crate.

It would be advantageous to develop a collapsible crate and a method of assembling a collapsible crate that is compact when the crate is collapsed and decreases a cost of the crate.

SUMMARY OF THE INVENTION

Presently provided by the invention, a collapsible crate and a method of assembling a collapsible crate that is compact when the crate is collapsed and decreases a cost of the crate, has surprisingly been discovered.

In one embodiment, the present invention is directed to a collapsible crate comprising a base, a first panel, a second panel, and a band style fastener. The base includes at least two stringers wherein the stringers define a gap therebetween. The first panel is at least partially disposed within the gap between the stringers. The second panel is at least partially disposed within the gap between the stringers. The band style fastener is disposed about a portion of the base and a portion of one of the first panel and the second panel. The band style fastener secures the one of the first panel and the second panel to the base. The first panel and the second panel at least partially disposed in the base facilitates a transition fit therebetween.

In another embodiment, the present invention is directed to a collapsible crate, comprising a base, a front panel, a back panel, a first side panel, a second side panel, a first band style fastener, and a second band style fastener. The base includes two exterior stringers and three interior stringers. The first of the exterior stringers and a first of the interior stringers define a first gap therebetween and a second of the exterior stringers and a second of the interior stringers define a second gap therebetween. The front panel comprises a first set of boards at least partially disposed within the first gap. The first set of boards are continuous in profile and straight along their whole length. The back panel comprises a second set of boards at least partially disposed within the second gap. The second set of boards are continuous in profile and straight along their whole length. The first side panel comprises a first pair of corner uprights at least partially disposed within the first gap and the second gap. The first pair of corner uprights are continuous in profile and straight along their whole length. The second side panel comprises a second pair of corner uprights at least partially disposed within the first gap and the second gap. The second pair of corner uprights are continuous in profile and straight along their whole length. The first band style fastener is disposed about a portion of the base and a portion of the first side panel. The second band style fastener is disposed about a portion of the base and a portion of the second side panel. The band style fasteners secure the first side panel and the second side panel to the base, and the front panel, the back panel, the first side panel, and the second side panel at least partially disposed in the base facilitates a transition fit therebetween.

The present invention also is directed to a method of assembling a collapsible crate. The method comprises the steps of providing a base, providing a first panel, partially disposing the first panel within the base, providing a second panel, partially disposing the second panel within the base, providing a band style fastener, and disposing the band style fastener about a portion of the base and a portion of one of the first panel and the second panel. The base includes at least two stringers, the stringers defining a gap therebetween. The first panel is partially disposed in the gap between the stringers. The second panel is partially disposed in the gap between the stringers. The band style fastener secures the one of the first panel and the second panel to the base. The first panel and the second panel at least partially disposed in the base facilitates a transition fit therebetween.

Various aspects of this invention will become apparent to those skilled in the art from the following detailed description of the preferred embodiment, when read in light of the accompanying drawings.

BRIEF DESCRIPTION OF THE DRAWINGS

The above, as well as other advantages of the present invention, will become readily apparent to those skilled in the art from the following detailed description when considered in the light of the accompanying drawings in which.

DETAILED DESCRIPTION OF THE INVENTION

It is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts of the present invention. Hence, specific dimensions, directions, orientations or other physical characteristics relating to the embodiments disclosed are not to be considered as limiting, unless expressly stated otherwise.

Figure 1:
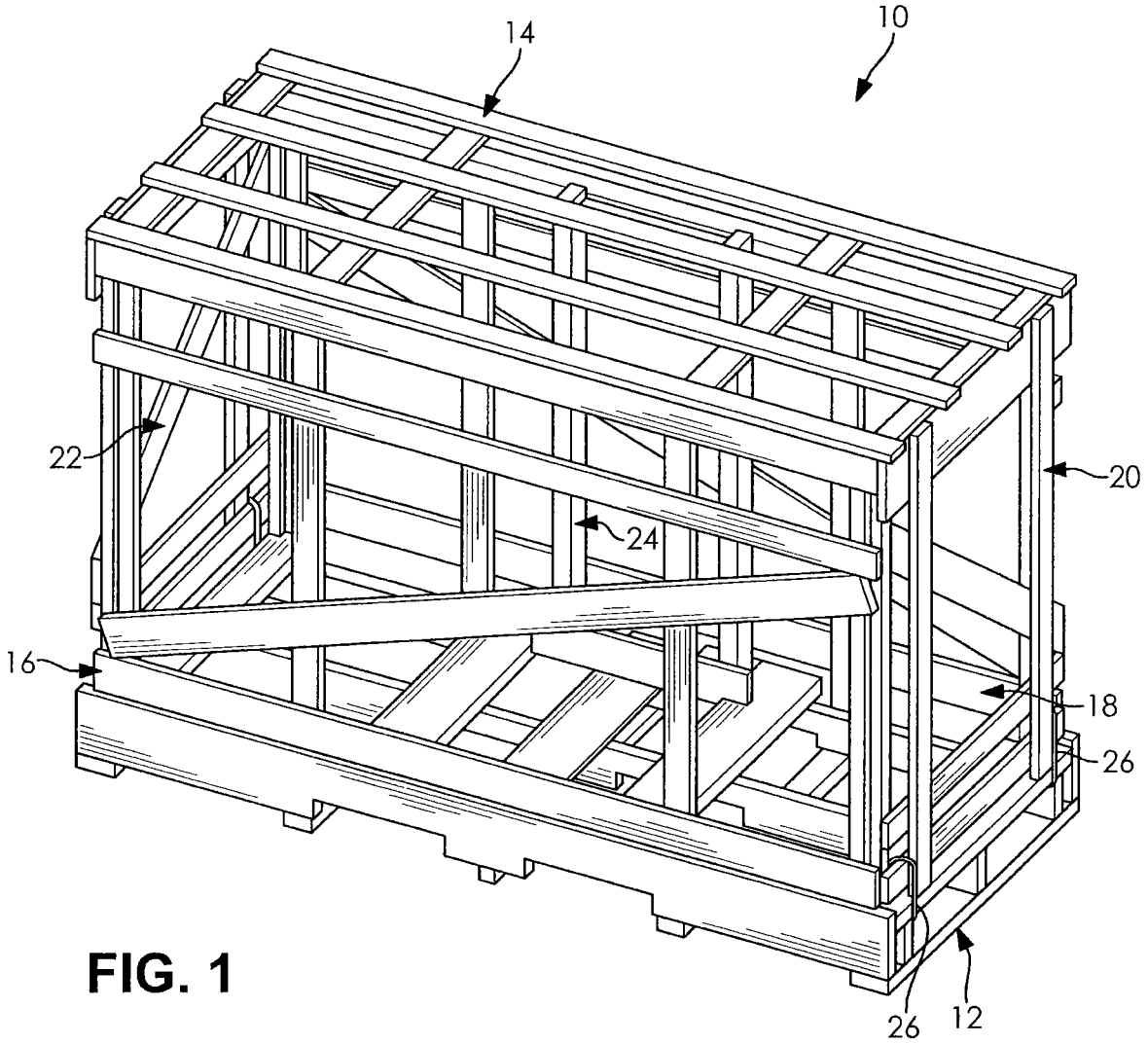
FIG. 1 is a perspective view of a collapsible crate according to an embodiment of the present invention.

FIG. 1 illustrates a crate 10 according to an embodiment of the invention. The crate 10 is collapsible and comprises a base 12, a top 14, a front panel 16, a back panel 18, a first side panel 20, a second side panel 22, and a back brace 24. A portion of the front panel 16, the back panel 18, the first side panel 20, and the second side panel 22 are disposed within the base 12. A transition fit between the front panel 16, the first side panel 20, and the second side panel 22 within the base 12 locates the front panel 16 with respect to the base 12. As understood in the art, a transition fit provides accurate locating of parts, but either a small amount of clearance or interference between those parts is permissible. Further, there is typically an overlapping of tolerance zones for mating parts. As the crate 10 is preferably formed from wood, which provides some degree of flexibility, a transition fit provides a proper amount of clearance or interference for locating the parts during assembly. A transition fit between the back panel 18, the first side panel 20, and the second side panel 22 within the base 12 locates the back panel 18 with respect to the base 12. The back brace 24 is disposed against the base 12 and the back panel 18. The back brace 24 is secured within the crate 10 when contents (not shown) are disposed within the crate 10 and the contents are secured to the base 12 and the back panel 18. The top 14 is disposed against the front panel 16, the back panel 18, the first side panel 20, and the second side panel 22. A portion of the top 14 is disposed within the crate 10 to locate and restrain the top 14 against the front panel 16, the back panel 18, the first side panel 20, and the second side panel 22. Upon assembly of the crate 10, which is detailed hereinbelow, the front panel 16, the back panel 18, the first side panel 20, and the second side panel 22 are secured to one another using horizontal banding (not shown). Further, upon assembly of the crate 10, the top 14, the front panel 16, the back panel 16, and the base 12 are secured to one another using vertical banding (not shown). Further, upon disposal of the first side panel 20 and the second side panel 22 within the base 12, the first side panel 20 and the second side panel 22 are respectively secured to the base using a band style fastener 26, shown in FIG. 8.

Figure 2A:
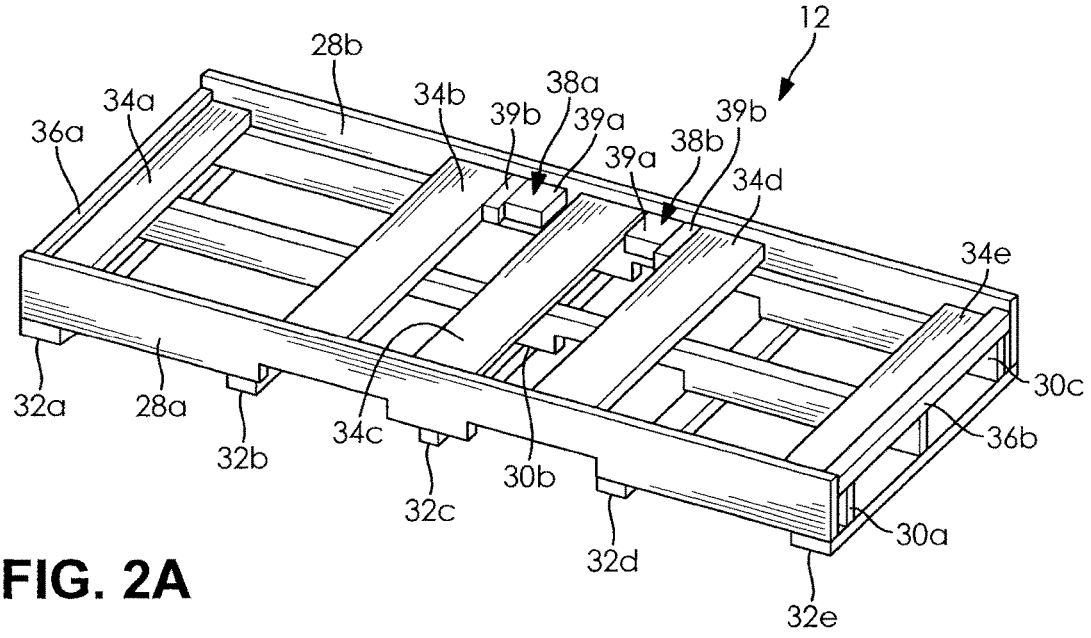
FIG. 2A is a perspective view of a base of the collapsible crate shown in FIG. 1.
Figure 2B:
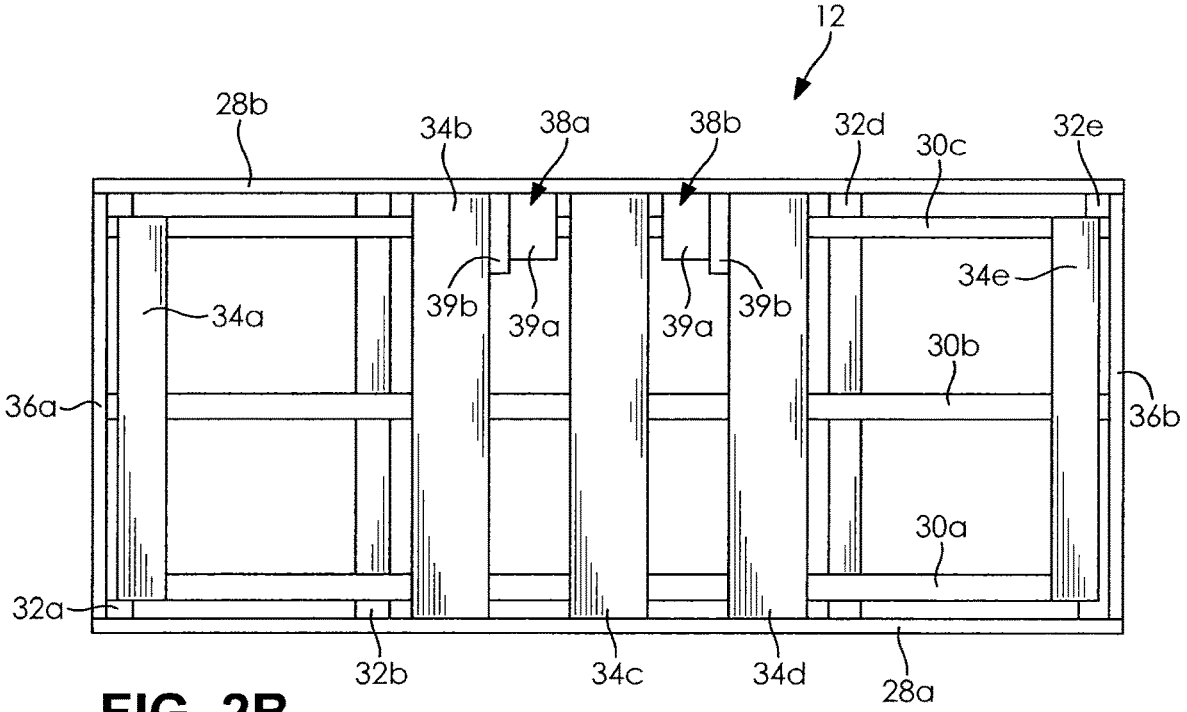
FIG. 2B is a top-plan view of a base of the collapsible crate shown in FIG. 1.

The base 12, shown in FIGS. 2A and 2B, comprises a pair of exterior stringers 28*a*, 28*b*, three interior stringers 30*a*, 30*b*, 30*c*, five lower deckboards 32*a*, 32*b*, 32*c*, 32*d*, 32*e*, five upper deckboards 34*a*, 34*b*, 34*c*, 34*d*, 34*e*, a pair of end supports 36*a*, 36*b*, and a pair of brace support assemblies 38*a*, 38*b*. The base 12 is of similar construction to a stringer-style pallet, where the deckboards 32*a*, 32*b*, 32*c*, 32*d*, 32*e*, 34*a*, 34*b*, 34*c*, 34*d*, 34*e* are oriented perpendicular to the stringers 28*a*, 28*b*, 30*a*, 30*b*, 30*c*. The components of the base 12 are formed from wood, however, they may also be formed from other materials, such as plastic or metal. As shown in FIGS. 1, 2A, and 2B, the base 12 comprises the three interior stringers 30*a*, 30*b*, 30*c*, the five lower deckboards 32*a*, 32*b*, 32*c*, 32*d*, 32*e*, and the five upper deckboards 34*a*, 34*b*, 34*c*, 34*d*, 34*e*; however, it is understood that the base 12 may comprise greater or fewer than these number of components, depending on a configuration of the crate 10. The lower deckboards 32*a*, 32*b*, 32*c*, 32*d*, 32*e* are secured to the stringers 28*a*, 28*b*, 30*a*, 30*b*, 30*c* in a parallel fashion using fasteners, such as, but not limited to, nails or screws. The upper deckboards 34*a*, 34*b*, 34*c*, 34*d*, 34*e* are secured to the stringers 30*a*, 30*b*, 30*c* in a parallel fashion using fasteners, such as, but not limited to, nails or screws. When the base is assembled, the upper deckboards 34*a*, 34*b*, 34*c*, 34*d*, 34*e* are located between the stringers 28*a*, 28*b*. The stringers 28*a*, 28*b*, 30*a*, 30*b*, 30*c* include notches 36 formed therein which are aligned with one another to facilitate lifting the crate 10. The end supports 36*a*, 36*b* are boards respectively secured to the stringers 28*a*, 28*b*, 30*a*, 30*b*, 30*c* adjacent the ends thereto using fasteners, such as, but not limited to, nails or screws. The end supports 36*a*, 36*b* are oriented perpendicularly to the stringers 28*a*, 28*b*, 30*a*, 30*b*, 30*c*. The pair of brace support assemblies 38*a*, 38*b* are secured to the stringers 28*b*, 30*c* adjacent the upper deckboard 34*c* using fasteners, such as, but not limited to, nails or screws. The brace support assemblies 38*a*, 38*b* each comprise inner blocks 39*a* and outer brace supports 39*b*. The inner blocks 39*a* may be secured to the outer brace supports 39*b* using fasteners and then the brace support assemblies 38*a*, 38*b* are secured to the exterior stringer 28*b* and the upper deckboards 34*b*, 34*d* using fasteners. Alternately, the inner blocks 39*a* and outer brace supports 39*b* may be respectively coupled to the exterior stringer 28*b* and the upper deckboards 34*b*, 34*d*. The outer brace supports 39*b* are spaced apart a distance that is about equal to a width of the back brace 24. A distance between the outer brace supports 39*b* facilitates a transition fit of the back brace 24 therebetween when the crate 10 is assembled. As shown in FIG. 2B, the interior stringers 30*a*, 30*c* are spaced apart from the exterior stringers 28*a*, 28*b* to facilitate a transition fit of a portion of the front panel 16, the back panel 18, the first side panel 20, and the second side panel 22 therebetween. It is understood that a construction of the base 12 as shown in FIGS. 2A and 2B is not limiting in nature, and that a construction of the base 12 may vary in a manner that allows the components of the base 12 to facilitate a transition fit of a portion of the front panel 16, the back panel 18, the first side panel 20, and the second side panel 22.

Figure 3:
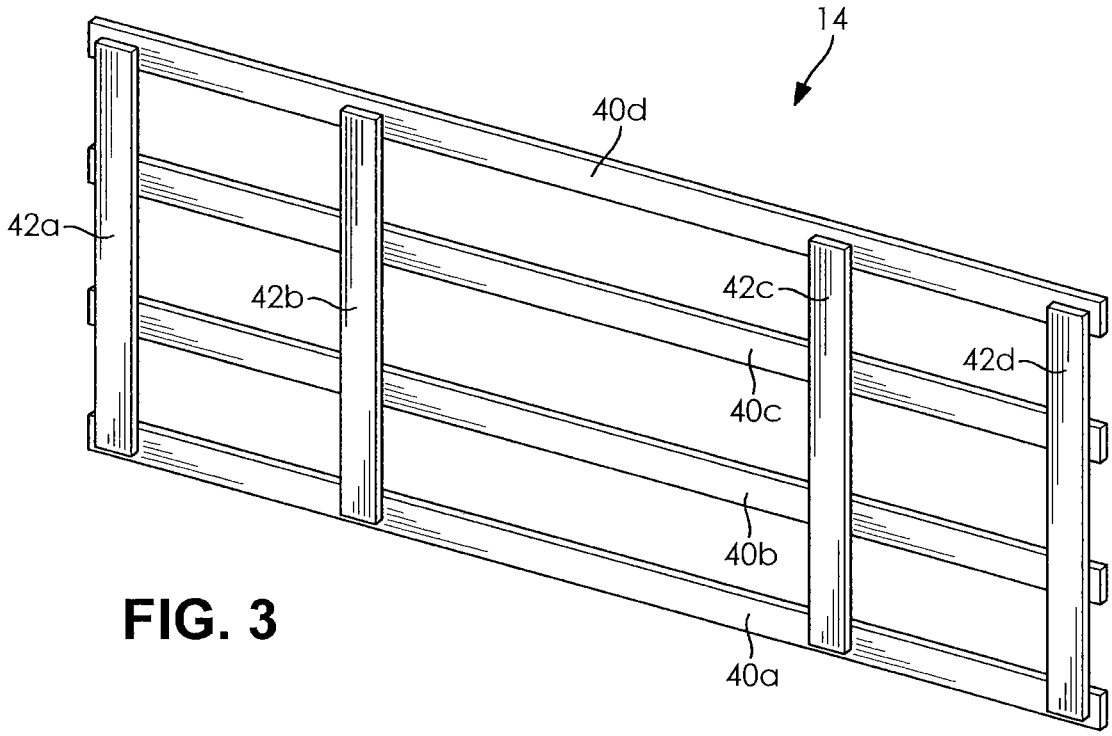
FIG. 3 is a perspective view of a top of the collapsible crate shown in FIG. 1.

The top 14, shown in FIG. 3, comprises two sets of boards arranged and fastened to one another in a grid pattern using fasteners, such as, but not limited to, nails or screws. The components of the top 14 are formed from wood, however, they may also be formed from other materials, such as plastic or metal. A first set of boards 40*a*, 40*b*, 40*c*, 40*d* are spaced apart from one another in a parallel fashion and are substantially equal in length to the base 12. A second set of boards 42*a*, 42*b*, 42*c*, 42*d* perpendicular to the first set of boards 40*a*, 40*b*, 40*c*, 40*d* are spaced apart from one another in a parallel fashion and are substantially equal in length to a distance between the front panel 16 and the back panel 18. When the front panel 16, the back panel 18, the first side panel 20, and the second side panel 22 are disposed within the base 12, the top 14 is disposed on the panels 16, 18, 20, 22, and the second set of boards 42*a*, 42*b*, 42*c*, 42*d* is disposed within the crate 10 to locate and restrain the top 14 against the panels 16, 18, 20, 22.

Figure 5:
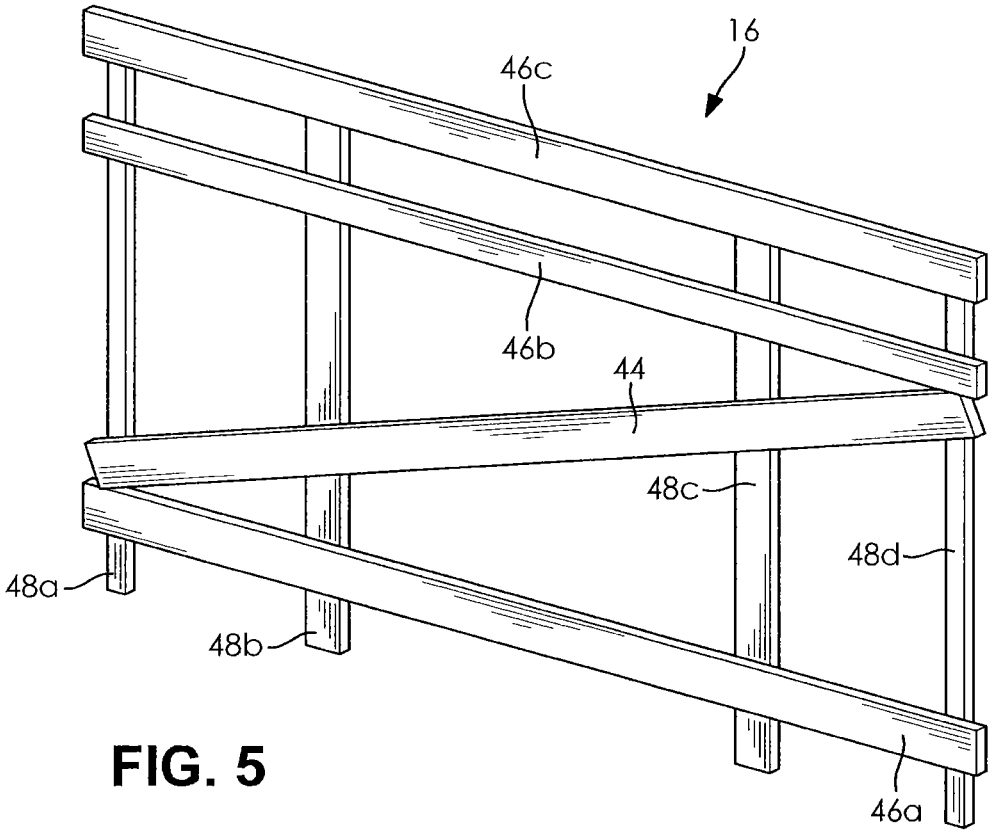
FIG. 5 is a perspective view of a front panel of the collapsible crate shown in FIG. 1.

The front panel 16, shown in FIG. 5, comprises two sets of boards and a first brace board 44 arranged and fastened to one another in a grid pattern using fasteners, such as, but not limited to, nails or screws. The components of the front panel 16 are formed from wood, however, they may also be formed from other materials, such as plastic or metal. A first set of boards 46*a*, 46*b*, 46*c* are spaced apart from one another in a parallel fashion and are substantially equal in length to the base 12. A second set of boards 48*a*, 48*b*, 48*c*, 48*d* perpendicular to the first set of boards 46*a*, 46*b*, 46*c* are spaced apart from one another in a parallel fashion. The second set of boards 48*a*, 48*b*, 48*c*, 48*d* are continuous in profile, straight along their whole length, and are oriented to be disposed between the exterior stringer 28*a* and the interior stringer 30*a* when the crate 10 is assembled. Further, a portion of each of the second set of boards 48*a*, 48*b*, 48*c*, 48*d* extends past the board 46*a*. The first brace board 44 is oriented obliquely to the first set of boards 46*a*, 46*b*, 46*c*, and disposed between the boards 46*a*, 46*b*.

Figure 4:
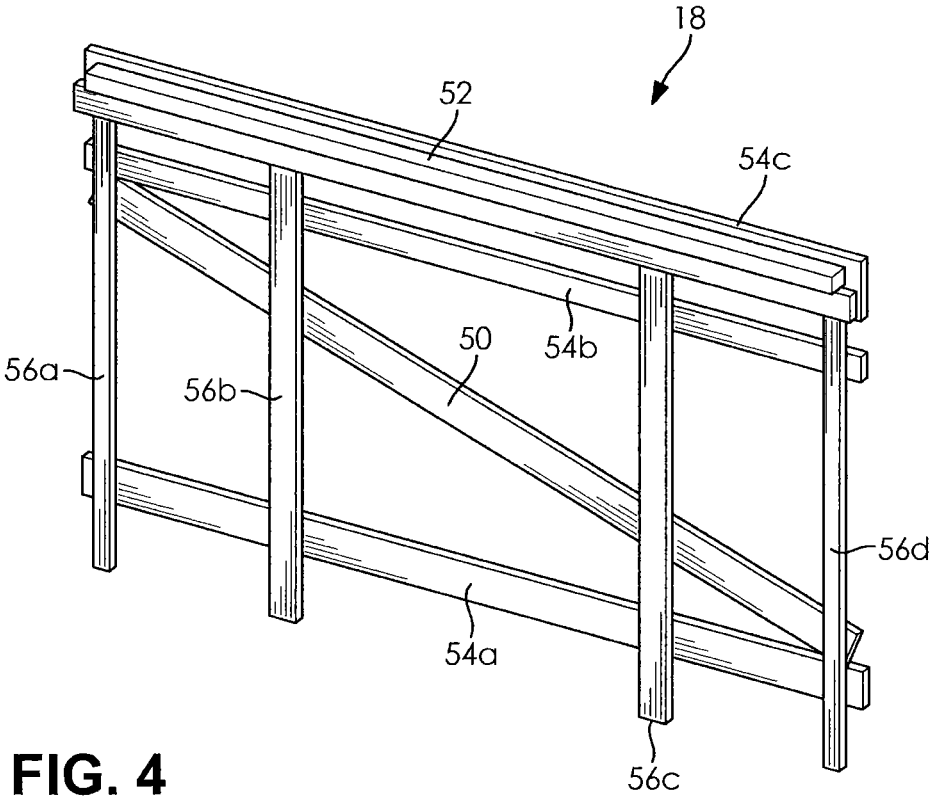
FIG. 4 is a perspective view of a back panel of the collapsible crate shown in FIG. 1.

The back panel 18, shown in FIG. 4, comprises two sets of boards, a second brace board 50, and a panel reinforcement assembly 52 arranged and fastened to one another in a grid pattern using fasteners, such as, but not limited to, nails or screws. The components of the back panel 18 are formed from wood, however, they may also be formed from other materials, such as plastic or metal. A first set of boards 54*a*, 54*b*, 54*c* are spaced apart from one another in a parallel fashion and are substantially equal in length to the base 12. A second set of boards 56*a*, 56*b*, 56*c*, 56*d* perpendicular to the first set of boards 54*a*, 54*b*, 54*c* are spaced apart from one another in a parallel fashion. The second set of boards 56*a*, 56*b*, 56*c*, 56*d* are continuous in profile, straight along their whole length, and are oriented to be disposed between the exterior stringer 28*b* and the interior stringer 30*c* when the crate 10 is assembled. Further, a portion of each of the second set of boards 56*a*, 56*b*, 56*c*, 56*d* extends past the board 46*a* and a portion of the board 54*c* extends past the boards 56*a*, 56*b*, 56*c*, 56*d* to facilitate mounting the panel reinforcement assembly 52. The second brace board 50 is oriented obliquely to the first set of boards 54*a*, 54*b*, 54*c*, and disposed between the boards 54*a*, 54*b*. The panel reinforcement assembly 52 comprises a pair of boards oriented in a parallel fashion to the first set of boards 54*a*, 54*b*, 54*c* adjacent the ends of the second set of boards 56*a*, 56*b*, 56*c*, 56*d*. A first board of the panel reinforcement assembly 52 is positioned opposite the board 54*c* and a second board of the panel reinforcement assembly 52 is positioned across the ends of the second set of boards 56*a*, 56*b*, 56*c*, 56*d*.

Figure 6:
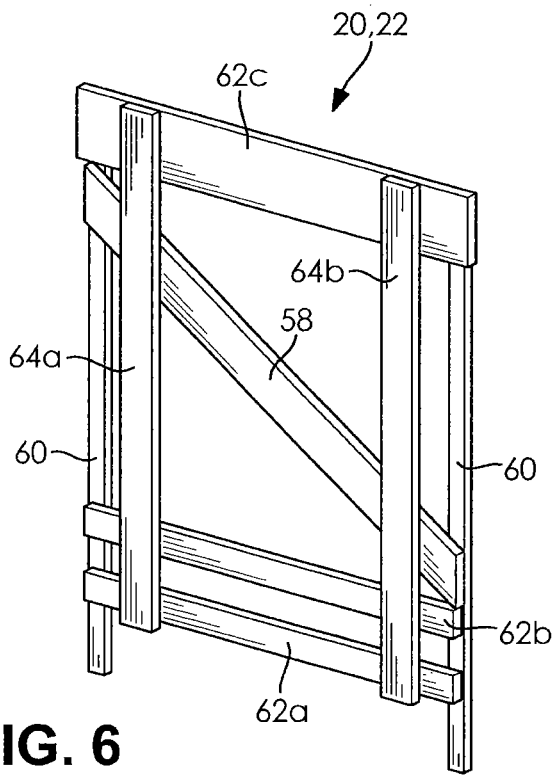
FIG. 6 is a perspective view of a side panel of the collapsible crate shown in FIG. 1.

The first side panel 20 and the second side panel 22 may be constructed identically to one another, as shown in FIG. 6. The first side panel 20 and the second side panel 22 comprise two sets of boards, a third brace board 58, and a pair of corner uprights 60 arranged and fastened to one another in a grid pattern using fasteners, such as, but not limited to, nails or screws. The components of the first side panel 20 and the second side panel 22 are formed from wood, however, they may also be formed from other materials, such as plastic or metal. A first set of boards 62*a*, 62*b*, 62*c* are spaced apart from one another in a parallel fashion and are substantially equal in length to a width of the base 12. A second set of boards 64*a*, 64*b* perpendicular to the first set of boards 62*a*, 62*b*, 62*c* are spaced apart from one another in a parallel fashion. The third brace board 58 is oriented obliquely to the first set of boards 62*a*, 62*b*, 62*c* and disposed between the boards 62*b*, 62*c*. The corner uprights 60 are respectively fastened adjacent the ends of the first set of boards 62*a*, 62*b*, 62*c* in a parallel fashion to the second set of boards 64*a*, 64*b*. The corner uprights 60 are continuous in profile and straight along their whole length. A portion of each of the corner uprights 60 extends past the board 62*a*. A portion of the corner uprights 60 are oriented to be respectively disposed between the exterior stringers 28*a*, 28*b* and the interior stringers 30*a*, 30*c*, abutting the end supports 36*a*, 36*b* when the crate 10 is assembled.

Figure 7:
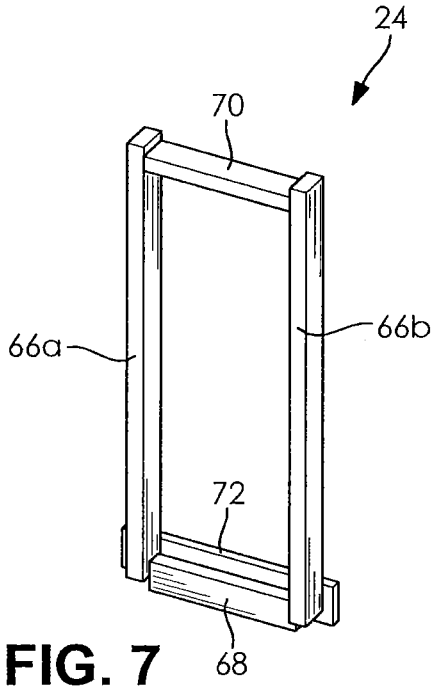
FIG. 7 is a perspective view of a back brace of the collapsible crate shown in FIG. 1.

The back brace 24, shown in FIG. 7, comprises four boards 66*a*, 66*b*, 68, 70 arranged in a rectangular manner and a having a guide board 72 fastened thereto. The boards 66*a*, 66*b*, 68, 70, 72 are fastened to one another using fasteners, such as, but not limited to, nails or screws. The components of the back brace 24 are formed from wood, however, they may also be formed from other materials, such as plastic or metal. The back brace 24 is secured within the crate 10 when contents (not shown) are disposed within the crate 10 and the contents are secured to the base 12 and the back panel 18. The boards 66*a*, 66*b* are oriented vertically and are spaced apart from one another in a parallel fashion. The boards 68, 70 are oriented perpendicular to the boards 66*a*, 66*b* and are spaced apart from one another in a parallel fashion, at opposite ends of the boards 66*a*, 66*b*. A portion of the board 66*a* extends below the boards 66*a*, 66*b*. The guide board 72 is oriented parallel to the boards 68, 70 and is longer than a distance between the boards 66*a*, 66*b* and fastened to an outer surface thereof. When the crate 10 is assembled, the guide board 72 rests against the upper deckboards 34*b*, 34*d*, the inner blocks 39*a*, the outer brace supports 39*b*, and the boards 66*a*, 66*b* rest against the panel reinforcement assembly 52. Further, it is understood that the back brace 24 may be used in an inverted position from what is shown in FIG. 1. When the back brace 24 is used in an inverted position, the guide board 72 is disposed adjacent the panel reinforcement assembly 52 and the board 70 rests on the upper deckboard 34*c* and against the outer brace supports 39*b*.

In use, the crate 10 is assembled during a loading of the crate 10. A user of the crate 10 begins the assembling and loading process by positioning the base 12 in a manner that facilitates moving the crate 10 in an assembled and loaded condition, such as by a fork truck. As a non-limiting example, in the loaded condition, the crate 10 may include as many as 45 or more glass panels having a total weight of about 2000 pounds. Following positioning of the base 12, the back panel 18 is disposed in the base 12. The user aligns the second set of boards 56*a*, 56*b*, 56*c*, 56*d* with the gap between the exterior stringer 28*b* and the interior stringer 30*c* and inserts the portion of each of the second set of boards 56*a*, 56*b*, 56*c*, 56*d* extending past the board 54*a* between the exterior stringer 28*b* and the interior stringer 30*c*. A transition fit between the back panel 18 and the base 12 locates the back panel 18 with respect to the base 12.

Next, the side panels 20, 22 are disposed in the base 12. The user aligns the corner uprights 60 of each of the side panels 20, 22 with the respective gaps between the exterior stringers 28*a*, 28*b* and the interior stringer 30*a*, 30*c* and inserts the portion of each of corner uprights 60 extending past the board 62*a* between the exterior stringers 28*a*, 28*b* and the interior stringer 30*a*, 30*c*. A transition fit between each of the side panels 20, 22 and the base 12, and the side panels 20, 22 and the back panel 18 locates the side panels 20, 22 with respect to the base 12. It is understood that a respective gap between the boards 56*a*, 56*d* and the end supports 36*a* and 36*b* is about equal to a thickness of the corner uprights 60, which further facilitates a transition fit of the back panel 18 and the side panels 20, 22.

Figure 8:
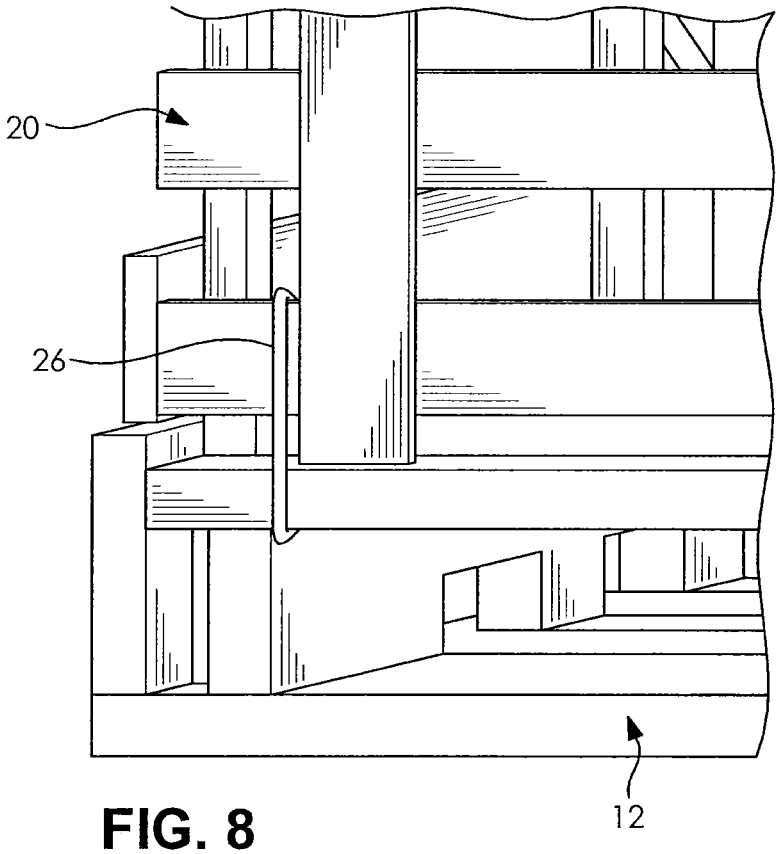
FIG. 8 is a partial, detail view of the collapsible crate shown in FIG. 1, showing the side panel secured to the base using a band style fastener.

Following placement of the side panels 20, 22, the user secures each of the side panels 20, 22 to the base 12 using two band style fasteners 26, as shown in FIG. 8. The band style fastener 26 is disposed around the board 62*a* of each of the side panels 20, 22 and the end supports 36*a*, 36*b*. The band style fastener 26 may be commonly referred to as a zip-tie or cable tie, but it is understood that other band style fasteners may be used to secure the side panels 20, 22 to the base 12. Two of the band style fasteners 26 are also applied between the side panels 20, 22 and the back panel 18 around the boards 56*a*, 56*d*, adjacent the junction of board 54*b* and the boards 56*a*, 56*d*. As a non-limiting example, the band style fastener 26 is about 20" in length and has a break strength of about 125 pounds of force.

Next, the user positions the back brace 24 against the upper deckboards 34*b*, 34*d*, and the brace support assemblies 38*a*, 38*b*, fitting between the outer brace supports 39*b* and the panel reinforcement assembly 52. Once the back brace 24 is positioned as described in one of the ways hereinabove, the user may begin the loading process. During loading, the user of the crate 10 rests a spacer (not shown) against the back brace 24. Then, a first item (not shown) is loaded against the spacer. Next, another spacer (not shown) may be used to separate subsequent items that are loaded. When the user completes the loading process by loading the appropriate number of items, the items are secured to the base 12 and the back panel 18 using banding (not shown) and assembly of the crate 10 continues. Such banding may be expendable or reusable and formed from a polymeric material; however, it is understood that other types of banding may also be used. As a non-limiting example, the items to be loaded into the crate 10 may be glass panels for use in automobiles where each of the panels may weigh from about 20 to 45 pounds per piece and the crate 10 may be typically used to hold between 1 and 45 items; however, it is understood that other items in other quantities may be loaded in the crate 10. Further, the crate 10 has a maximum internal weight capacity of about 2000 pounds; however, it is understood that depending on actual construction used with the crate, a maximum internal weight capacity may vary.

Next, the user disposes the front panel 16 in the base 12. The user aligns the second set of boards 48*a*, 48*b*, 48*c*, 48*d* with the gap between the exterior stringer 28*a* and the interior stringer 30*a* and inserts the portion of each of the second set of boards 48*a*, 48*b*, 48*c*, 48*d* extending past the board 46*a* between the exterior stringer 28*a* and the interior stringer 30*a*. A transition fit between the front panel 16 and the base 12 locates the front panel 16 within the base 12. It is understood that a respective gap between the boards 48*a*, 48*d* and the end supports 36*a* and 36*b* is about equal to a thickness of the corner uprights 60, which further facilitates a transition fit of the front panel 18 and the side panels 20, 22. While not shown in FIG. 1, it is understood that the front panel 16 and the back panel 18 may also be secured to the side panels 20, 22 using additional band style fasteners 26. With regards to the front panel 16, two of the band style fasteners 26 may be positioned adjacent the board 46*c*, around both the boards 48*a*, 48*d* and the corner uprights 60. With regards to the back panel 18, two of the band style fasteners 26 are positioned adjacent the board 54*c*, around both the boards 56*a*, 56*d* and the corner uprights 60.

Next, the user disposes the top 14 against the front panel 16, the back panel 18, the first side panel 20, and the second side panel 22. The second set of boards 42*a*, 42*b*, 42*c*, 42*d* of the top 14 are oriented downward and are disposed within the crate 10 to locate and restrain the top 14 against the front panel 16, the back panel 18, the first side panel 20, and the second side panel 22.

Lastly, the user bands the crate 10 to secure the components to one another. The front panel 16, the back panel 18, the first side panel 20, and the second side panel 22 are then secured to one another using horizontal banding (not shown), which may be expendable or reusable and formed from a polymeric material; however, it is understood that other types of banding may also be used. It is understood that the board 62*c* of the side panels 20, 22 may be notched to facilitate restraining the horizontal banding; however, it is understood that other components of the side panels 20, 22 or of the crate 10 may also be notched to facilitate banding. The top 14, the front panel 16, the back panel 16, and the base 12 are then secured to one another using vertical banding (not shown), which may be expendable or reusable and formed from a polymeric material; however, it is understood that other types of banding may also be used. Further, it is understood that other types of banding may also be used.

The crate 10 and the method of assembling the crate 10 described hereinabove provides a collapsible crate that is compact when the crate 10 is collapsed and decreases a cost of manufacturing the crate 10. The crate 10 provides a 3 to 1 ratio of shipping volume for return when placed in a collapsed condition as opposed to an assembled condition, thus decreasing a cost of return shipping of crates 10 placed in a collapsed condition by increasing packing density. Further, the boards 48*a*, 48*b*, 48*c*, 48*d*, 56*a*, 56*b*, 56*c*, 56*d* and the uprights 64*a*, 64*b* are continuous in profile and straight along their whole length, simplifying the construction of the panels 16, 18, 20, 22 and thus decreasing their cost.

In accordance with the provisions of the patent statutes, the present invention has been described in what is considered to represent its preferred embodiments, however, it should be noted that the invention can be practiced otherwise than as specifically illustrated and described without departing from its scope or spirit.

What is claimed is:

1. A collapsible crate, comprising:

a base including at least two stringers, the stringers defining a gap therebetween;

a first panel at least partially disposed within the gap between the stringers;

a second panel at least partially disposed within the gap between the stringers; and a band style fastener disposed about a portion of the base and a portion of one of the first panel and the second panel, wherein the band style fastener secures the one of the first panel and the second panel to the base, and wherein there is a transition fit between the first panel and the base, and there is a transition fit between the second panel and the base.

2. The collapsible crate according to claim 1, the base including at least four stringers, wherein two of the stringers are exterior stringers and two of the stringers are interior stringers.

3. The collapsible crate according to claim 2, wherein one of the exterior stringers and one of the interior stringers define a first gap and a remaining one of the exterior stringers and the interior stringers define a second gap.

4. The collapsible crate according to claim 1, wherein the first panel and the second panel are comprised of two sets of boards arranged and fastened to one another in a grid pattern.

5. The collapsible crate according to claim 1, wherein the band style fastener is a cable tie.

6. The collapsible crate according to claim 1, wherein the collapsible crate may be placed in a loaded condition by placing items in the crate.

7. The collapsible crate according to claim 1, wherein the first panel is one of a front panel and a back panel and the second panel is a side panel.

8. The collapsible crate according to claim 1, wherein the side panel comprises two corner uprights at least partially disposed within the gap between the stringers.

9. The collapsible crate according to claim 1, wherein the portions of the first panel and the second panel disposed within the gap contact one another to facilitate the transition fit therebetween.

10. The collapsible crate according to claim 1, wherein the first panel and the second panel each comprise a set of boards at least partially disposed within the gap between the stringers, each of the set of boards being continuous in profile and straight along their whole length.

11. A collapsible crate, comprising:

a base including two exterior stringers and three interior stringers, a first of the exterior stringers and a first of the interior stringers defining a first gap therebetween and a second of the exterior stringers and a second of the interior stringers defining a second gap therebetween;

a front panel comprising a first set of boards at least partially disposed within the first gap, the first set of boards being continuous in profile and straight along their whole length;

a back panel comprising a second set of boards at least partially disposed within the second gap, the second set of boards being continuous in profile and straight along their whole length;

a first side panel comprising a first pair of corner uprights at least partially disposed within the first gap and the second gap, the first pair of corner uprights being continuous in profile and straight along their whole length;

a second side panel comprising a second pair of corner uprights at least partially disposed within the first gap and the second gap, the second pair of corner uprights being continuous in profile and straight along their whole length;

a first band style fastener disposed about a portion of the base and a portion of the first side panel;

a second band style fastener disposed about a portion of the base and a portion of the second side panel, wherein the band style fasteners secure the first side panel and the second side panel to the base, and wherein there is a transition fit between the front panel and the base, and there is a transition fit between the back panel and the base.

12. A method of assembling a collapsible crate, comprising the steps of:

providing a base including at least two stringers, the stringers defining a gap therebetween;

providing a first panel;

partially disposing the first panel within the gap between the stringers;

providing a second panel;

partially disposing the second panel within the gap between the stringers;

providing a band style fastener; and disposing the band style fastener about a portion of the base and a portion of one of the first panel and the second panel, wherein the band style fastener secures the one of the first panel and the second panel to the base, and wherein there is a transition fit between the first panel and the base, and there is a transition fit between the second panel and the base.

13. The method according to claim 12, wherein the base includes at least four stringers, wherein two of the stringers are exterior stringers and two of the stringers are interior stringers.

14. The method according to claim 13, wherein one of the exterior stringers and one of the interior stringers define a first gap and a remaining one of the exterior stringers and the interior stringers define a second gap.

15. The method according to claim 12, wherein the first panel and the second panel are comprised of two sets of boards arranged and fastened to one another in a grid pattern.

16. The method according to claim 12, wherein the band style fastener is a cable tie.

17. The method according to claim 12, further comprising the step of placing the collapsible crate in a loaded condition by placing items in the crate.

18. The method according to claim 12, wherein the first panel is one of a front panel and a back panel and the second panel is a side panel.

19. The method according to claim 18, wherein the side panel comprises two corner uprights at least partially disposed within the gap between the stringers.

20. The method according to claim 12, wherein the portions of the first panel and the second panel disposed within the gap contact one another to facilitate the transition fit therebetween.

21. The method according to claim 12, wherein the first panel and the second panel each comprise a set of boards at least partially disposed within the gap between the stringers, each of the set of boards being continuous in profile and straight along their whole length.

* * * * *